US009901929B2

(12) United States Patent
Irving

(10) Patent No.: US 9,901,929 B2
(45) Date of Patent: Feb. 27, 2018

(54) JAW CRUSHER MACHINE

(71) Applicant: Harry Irving, Calgary (CA)

(72) Inventor: Harry Irving, Calgary (CA)

( * ) Notice: Subject to any disclaimer, the term of this patent is extended or adjusted under 35 U.S.C. 154(b) by 281 days.

(21) Appl. No.: 14/819,354

(22) Filed: Aug. 5, 2015

(65) Prior Publication Data

US 2017/0036212 A1 Feb. 9, 2017

(51) Int. Cl.
*B02C 1/00* (2006.01)
*B02C 1/06* (2006.01)
*B02C 1/02* (2006.01)

(52) U.S. Cl.
CPC . *B02C 1/06* (2013.01); *B02C 1/02* (2013.01)

(58) Field of Classification Search
CPC ..... B02C 1/02; B02C 1/06
USPC ..... 241/264, 266–268, 101.73
See application file for complete search history.

(56) References Cited

U.S. PATENT DOCUMENTS 2,487,744 A 11/1949 Waters
2,505,132 A * 4/1950 Meinhardt ..... B02C 1/06 241/148
2,626,759 A 1/1953 Barber et al.
2,701,107 A 2/1955 Johnson
2,737,349 A * 3/1956 Hicken ..... B02C 1/06 241/140
2,998,936 A * 9/1961 Gruender ..... B02C 1/02 241/140
3,001,729 A * 9/1961 Conway ..... B02C 1/06 241/148
3,145,938 A * 8/1964 Pollitz ..... B02C 1/06 241/140
3,211,388 A * 10/1965 Gartner ..... B02C 1/02 241/147
4,248,390 A 2/1981 Toole
4,509,699 A 4/1985 Tanaka et al.
4,886,217 A 12/1989 van der Wal
5,172,869 A 12/1992 Kitsukawa et al.
5,397,069 A 3/1995 Kitsukawa et al.
5,490,636 A 2/1996 Schrödl
5,749,530 A 5/1998 Nakayama et al.
5,769,334 A 6/1998 Nakayama et al.
6,641,068 B2 11/2003 Ostergaard
6,644,577 B2 11/2003 Togashi et al.
6,957,786 B2 10/2005 Bratton et al.
7,143,970 B2 12/2006 Ha

* cited by examiner

*Primary Examiner* — Faye Francis

(57) ABSTRACT

A jaw crusher machine has a double-acting jaw (110) that linearly reciprocates to reduce abrasive wear and tilts back and forth during the crushing and discharge strokes to create a peristaltic action that, depending on the direction of rotation of the driven shaft (118), aids the ingestion, crushing and discharge of either hard or soft feed materials.

28 Claims, 7 Drawing Sheets

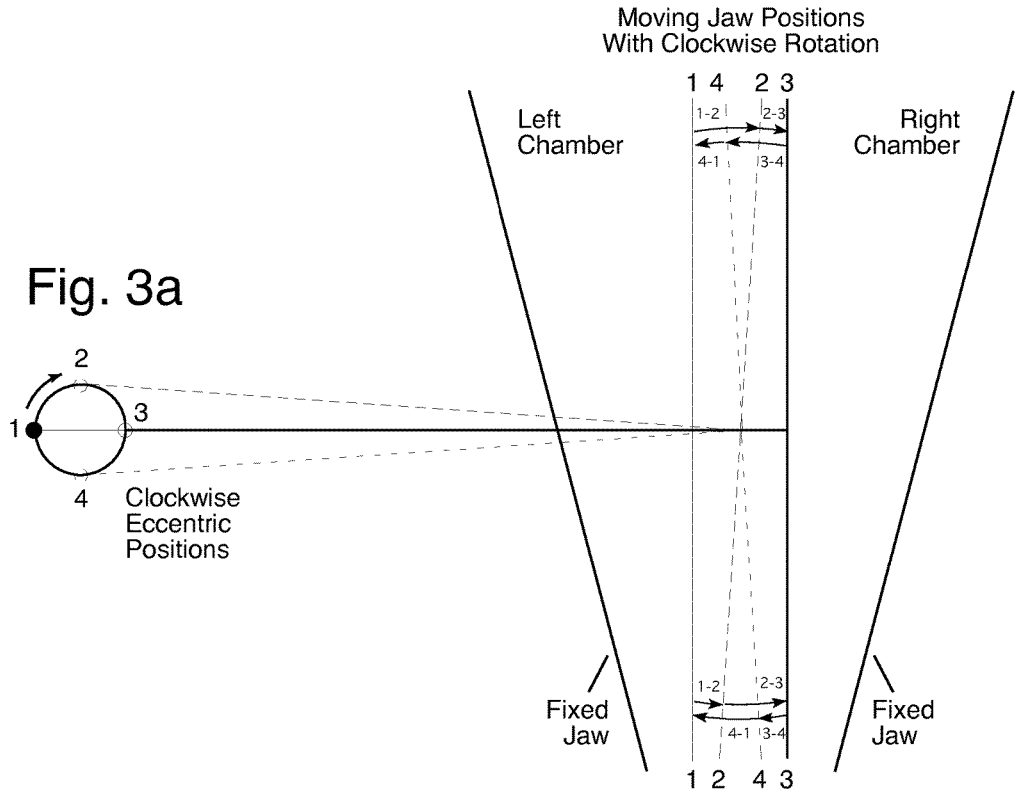

Fig. 3a

Fig. 3b

CRUSHER OPERATION DURING CLOCKWISE ROTATION

| | |
|---|---|
| 1-2: BEGIN LEFT DISCHARGE & RIGHT CRUSH<br>Chambers begin discharge on left, crush on right -<br>Tilting jaw opens wider at top left than at bottom -<br>Jaw opens for filling at top left *before* crushed -<br>rock is released at bottom left later in the stroke<br>Left chamber slowly begins to discharge -<br>*Timing of jaw tilt IMPEDES left discharge & fill -* | 2-3: FINISH LEFT FILL & RIGHT CRUSH<br>- Chambers finish fill on left, crush on right;<br>- Jaw finally opens wide at bottom left;<br>- Discharge and fill proceeds in left chamber as crushed rock finally released on bottom left;<br>- Left chamber completes the fill;<br>- *Timing of jaw tilt IMPEDES left discharge & fill.* |
| 4-1: FINISH RIGHT FILL & LEFT CRUSH<br>Chambers finish fill on right, crush on left -<br>Jaw finally opens wide at bottom right -<br>Discharge and fill proceeds in right chamber as -<br>crushed rock finally released on bottom right -<br>Right chamber completes the fill -<br>*Timing of jaw tilt IMPEDES right discharge & fill -* | 3-4: BEGIN LEFT CRUSH & RIGHT DISCHARGE<br>- Chambers begin discharge on right, crush on left;<br>- Tilting jaw opens wider at top right than at bottom;<br>- Jaw opens for filling at top right *before* crushed rock is released at bottom right later in the stroke;<br>- Right chamber slowly begins to discharge;<br>- *Timing of jaw tilt IMPEDES right discharge & fill.* |

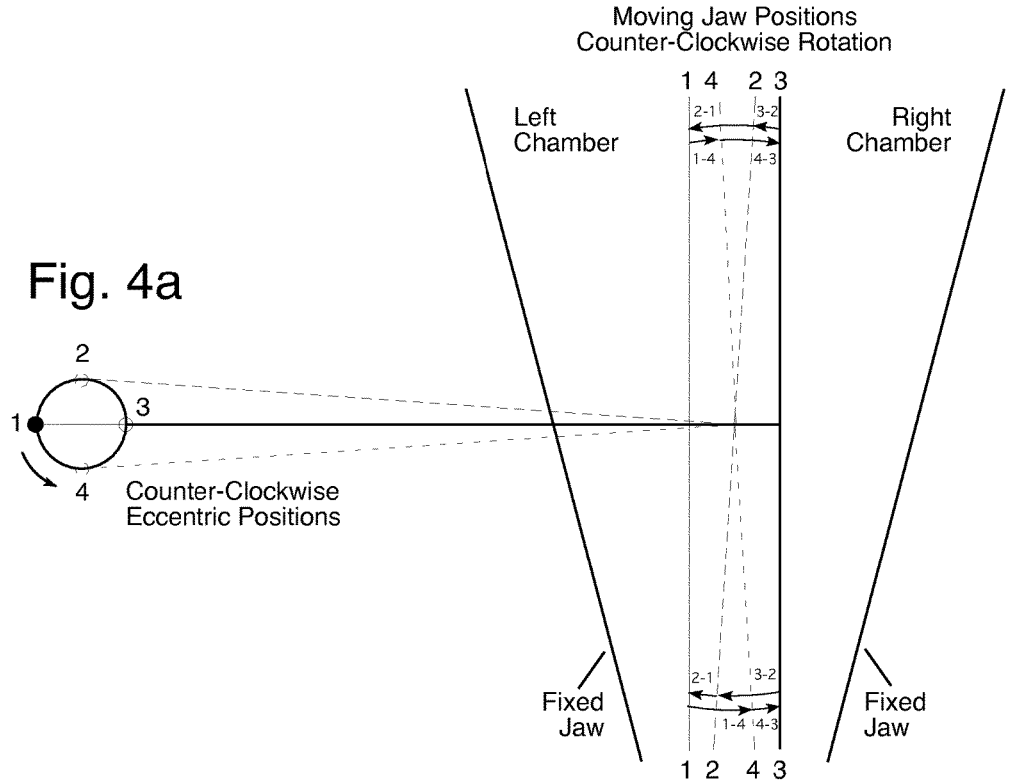

Fig. 4a

Fig. 4b

CRUSHER OPERATION DURING COUNTER-CLOCKWISE ROTATION

2-1: FINISH RIGHT FILL & LEFT CRUSH
Chambers finish fill on right, crush on left -
Tilting jaw finally opens wide at top right -
Right chamber fills rapidly after crushed rock -
is released early in the stroke at bottom right
Right chamber completes the fill -
*Timing of jaw tilt ASSISTS right discharge & fill -*

3-2: BEGIN RIGHT DISCHARGE & LEFT CRUSH
- Chambers begin discharge on right, crush on left;
- Tilting jaw opens wider at bottom right than at top;
- Jaw releases crushed rock at bottom right before opening up for fill at top right;
- Right chamber quickly begins to discharge;
- *Timing of jaw tilt ASSISTS right discharge & fill.*

1-4: BEGIN LEFT DISCHARGE & RIGHT CRUSH
Chambers begin discharge on left, crush on right -
Tilting jaw opens wider at bottom left than at top -
Jaw releases crushed rock at bottom left -
*before* opening up for fill at top left
Left chamber quickly begins to discharge -
*Timing of jaw tilt ASSISTS left discharge & fill -*

4-3: FINISH LEFT FILL & RIGHT CRUSH
- Chambers finish fill on left, crush on right;
- Tilting jaw finally opens wide at top left;
- Left chamber fills rapidly after crushed rock is released early in the stroke at bottom left;
- Left chamber completes the fill;
- *Timing of jaw tilt ASSISTS left discharge & fill.*

JAW CRUSHER MACHINE

CROSS-REFERENCE TO RELATED APPLICATIONS

This application claims the benefit of provisional patent application Ser. No. 62/042,138, filed 2014 Aug. 26 by the present inventor.

BACKGROUND

Prior Art

The following is a tabulation of some prior art that presently appears relevant:

| U.S. patents | | | |
|---|---|---|---|
| Pat. No. | Kind Code | Issue Date | Patentee |
| 5,749,530 | B1 | 1998 May 12 | Nakayama, et al. |
| 4,248,390 | B1 | 1979 Jan. 23 | Toole |
| 2,701,107 | B1 | 1955 Feb. 1 | Johnson |

Currently there are a number of solutions for crushing materials such as rock, gravel, coal, mineral ore and reclaimed concrete or asphalt. Some of these solutions are large, expensive, high capacity machines intended for continuous stationary use and permanent installation. These solutions fail to meet the needs of smaller-scale industries that require a small but sturdy and relatively inexpensive portable crusher that can be easily moved to different locations to quickly and reliably process smaller quantities of varied materials.

Other solutions provide portability at the expense of versatility. Portable machines that focus on crushing soft materials often suffer from excessive jaw wear due to abrasive chafing and scuffing. Commonly used jaw materials such as manganese steel that work-harden under impact have unsatisfactory wear resistance in applications where abrasive fines adhere to and plug the jaws and impact loads are insufficient to work-harden the steel jaws. Alternative jaw material such as chrome white iron is inherently very hard, but is so slippery it does not grip the feed material well and causes processing inefficiency due to upward-angled crushing forces that pinch the raw feed material and shoot it back up against the incoming flow.

Machines designed primarily to crush hard materials often suffer from plugging when challenged to process softer materials such as reclaimed asphalt which, regardless of jaw material, can adhere to the crushing jaws as a sticky mass, particularly in warm weather. In either case, when such single-purpose machines eventually plug, they often require partial disassembly to clear the crushing chamber. As a consequence existing portable crushers are inherently limited in their ability to process a wide range of feed materials efficiently and at relatively low cost.

The path of motion of the moveable jaw relative to a fixed jaw can have either a positive or negative effect on jaw crusher machine operation, depending on the feed material. For example, the component of jaw movement perpendicular to the fixed jaw creates the compressive forces needed to break hard material such as rock and concrete. However, these compressive forces can also cause softer material such as reclaimed asphalt to adhere to the crusher jaws as a sticky mass.

Conversely, the component of jaw movement parallel to a fixed jaw creates shear forces that help to fragment soft material such as reclaimed asphalt. Shear forces parallel to a fixed jaw can hasten or delay the passage of material through the crusher, depending on whether the shear forces act with or against the flow of feed material. With appropriate machine design, the relative presence or absence of shear forces can be used to advantage to control certain aspects of crusher operation, for example to assist the ingestion, transport and discharge of hard or soft materials. Unfortunately parallel jaw movement also leads to a deleterious chafing or scuffing action of material squeezed between the fixed and moveable jaws that increases abrasive wear of the jaws.

As a way to optimize crusher performance, variations of the jaw crusher machine have been designed to minimize, maximize or otherwise control the ratio of shear force to compressive force generated during the crushing stroke. For example, U.S. Pat. No. 5,749,530 teaches a single-sided swing-arm crusher designed to fragment soft materials such as reclaimed asphalt by means of shear forces that vary along the crushing surface. The jaw reciprocates in a direction substantially parallel to the crushing surfaces, and the pivot geometry of the swinging jaw constrains jaw motion so the ratio of shear to compressive forces is greatest at discharge at the bottom of the jaws and least at the top of the jaws. The strong wiping action of the moveable jaw against the fixed jaw is intended to prevent soft materials from adhering and keep material moving though the machine. In practice, this single-acting high-shear design has relatively low throughput and is subject to rapid abrasive jaw wear around the discharge point.

U.S. Pat. No. 2,701,107 discloses a double-acting swing-arm jaw crusher with twice the throughput of a single-action swing-arm crusher of similar size. The jaw reciprocates along a shallow arc in a direction substantially perpendicular to the crushing surfaces, maximizing compressive forces and minimizing shear forces on the crushing surfaces. Compared to machines that reciprocate the jaw substantially parallel to the crushing surfaces, perpendicular reciprocation significantly reduces abrasive wear. However, a pivot link constrains the jaw to swing along an arc between the fixed jaws, and the component of arcuate movement parallel to the crushing surfaces creates repetitive shear forces that contribute to abrasive wear of the jaws. The patent does not teach any advantage to reversing the direction of machine rotation and the machine was not manufactured to do so.

U.S. Pat. No. 4,248,390 teaches a double-acting double-eccentric jaw crusher that completely eliminates vertical motion or tilting of the moveable jaw, thereby producing a fixed and uniform ratio of shear to compressive force over the entire crushing surface throughout the crushing stroke, and correspondingly uniform abrasive wear on the crushing surfaces. The crushing action is unaffected by the direction of driving shaft rotation. Although the design is effective for crushing hard materials, its motion is inflexible and does not provide the versatility to also handle softer materials.

It would be desirable to have a jaw crusher machine that reduces abrasive wear of the crushing surfaces when breaking hard materials or crushing soft materials. Furthermore, it would also be desirable to have a jaw crusher machine that can use the hardest, most wear-resistant jaw materials without developing jaw forces that detrimentally oppose or impede the ingestion of feed material. Still further, it would be desirable to have a jaw crusher machine that is resistant to plugging during operation, and is easily cleared if the crusher does become plugged. Therefore, there currently exists a need in the industry for a strong, durable, compact and high capacity jaw crusher machine that moves the crushing surfaces in such a way as to allow the use of low-friction, high-hardness jaw materials to reduce abrasive wear while assisting the ingestion of feed material and/or discharge of processed material, and which can be cleared with minimum effort should the machine become plugged during operation.

SUMMARY

The present invention advantageously fills the aforementioned deficiencies by providing a jaw crusher machine which has a crushing action easily adapted to break hard materials such as rock and concrete or crush softer material such as asphalt, which is resistant to plugging and easily cleared with minimal effort by the operator should plugging occur, and which minimizes jaw motions that abrasively wear the crushing surfaces or cause spit-back of feed material.

In accordance with one embodiment, the present invention provides a jaw crusher machine comprising a substantially rectangular frame having a horizontal base and spaced apart interconnected side walls extending upwardly from said base, a pair of fixed jaws mounted transversely between said side walls so as to form the opposing walls of a downwardly tapering chamber, and a substantially vertical jaw member having crushing surfaces on opposite sides thereof, said vertical jaw member being pivotally connected substantially at the midpoint of its height to linear bearings affixed to each sidewall between said fixed jaws, said linear bearings supporting and constraining said vertical jaw to substantially horizontal reciprocating pivotal motion, a bearing housing extending across one end of said frame between said side walls and spaced above said base, a shaft rotatably mounted within said bearing housing, a reversible means for rotating said shaft, an eccentric fixed on said shaft near each of its ends, substantially horizontally inclined connecting rods carried by and operably connected at one of their ends to said eccentrics, the opposite ends of said connecting rods being rigidly connected to said vertical jaw member, said linear bearings supporting and constraining said vertical jaw to substantially horizontal reciprocating pivotal motion.

In accordance with another embodiment, the present invention may have first connecting rods connected at one of their ends to the eccentric and pivotally connected at their opposite ends to second connecting rods rigidly attached to the vertical jaw, the first connecting rods being pivotally supported at a point along their length by linear bearings that constrain said first rods to substantially horizontal reciprocating pivotal motion.

Advantages

The present invention is superior when compared with other known devices or solutions because, when the direction of shaft rotation is set for crushing hard materials, the present invention virtually eliminates the chafing and scuffing jaw motions that cause shear-induced wear on the crushing surfaces. The crushing forces are substantially compressive and perpendicular to the face of the fixed jaws, minimizing any upward-directed shear forces that tend to pinch the raw feed material and spit it back up against the incoming flow. This allows very hard and wear-resistant, low-friction jaw materials such as chrome white iron to be used without causing inefficient and dangerous spit-back of hard feed materials against the incoming flow.

Conversely, when the direction of shaft rotation is set for crushing soft materials, the present invention reduces the possibility of plugging by increasing the shear forces that encourage the movement of sticky material along the crushing surfaces and through the crushing chamber. Furthermore, the moveable jaw tilts systematically during horizontal reciprocation, initiating the crushing stroke at either the top or bottom edge of the jaw depending on the direction of driving shaft rotation. The resulting peristaltic motion of the moveable jaw relative to the fixed jaws assists the ingestion, crushing and discharge of either soft or hard material, depending on the direction of shaft rotation, and provides a plug-clearing action for both hard and soft materials when the direction of shaft rotation is reversed.

The present invention is unique in that it is structurally different from other known devices or solutions. More specifically, the present invention is unique due in part to the presence of linear bearings on each sidewall of the crushing chamber which support and constrain the moveable vertical jaw to substantially horizontal reciprocating pivotal motion, thereby minimizing wear on the crushing surfaces. Furthermore, the reciprocating connecting rods systematically tilt the moveable jaw to vary the shape of the crushing chambers in a peristaltic manner. Still further, the means of eccentric shaft rotation is reversible, thereby allowing the peristaltic action of the tilting centre jaw against the fixed jaws to preferentially assist either the breaking of hard material or crushing of soft material, or the clearing of plugged material, depending on the direction of shaft rotation.

Accordingly several advantages of one or more aspects are as follows: to provide a jaw crusher machine that does not greatly suffer from any of the problems or deficiencies associated with prior solutions, that operates more smoothly with less vibration, that is more economical to produce, easier to manufacture, easier to repair and more durable, and that is smaller and more lightweight than other solutions, thereby enabling the device to be more easily portable. Other advantages of one or more aspects will be apparent from a consideration of the drawings and ensuing description.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DRAWINGS—FIGURES

In the drawings, closely related figures have the same number but different alphabetic suffixes.

Figure 1:
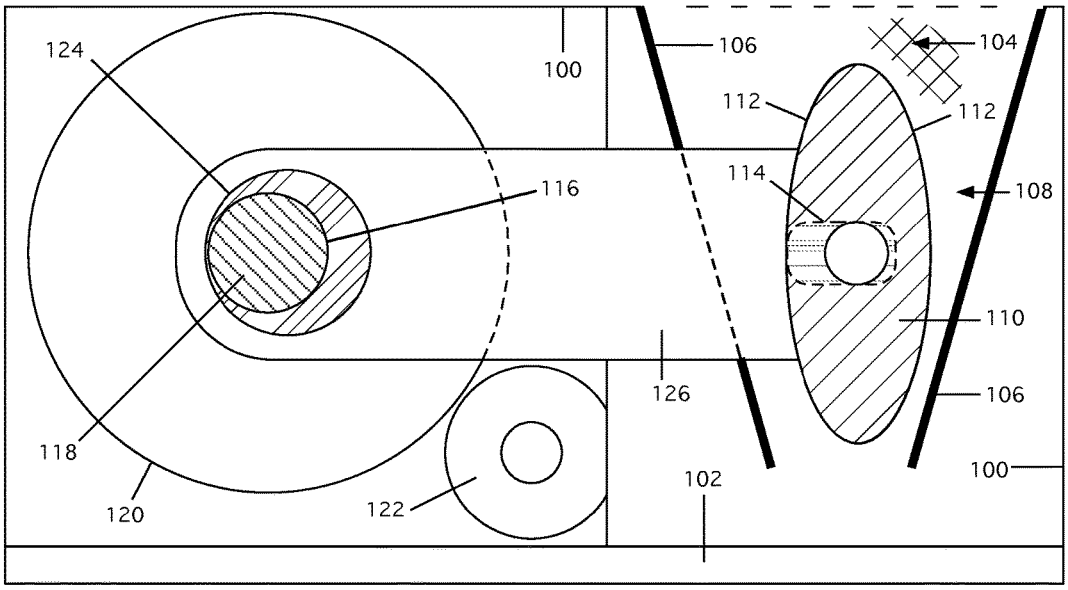
FIG. 1 shows an illustrative side view of a single-stage crusher mechanism showing an embodiment wherein the eccentrics drive the moveable jaw by means of connecting rods rigidly connected to the jaw.

FIG. 3*a* shows the sequence of jaw positions defining four stages of crushing and discharge for clockwise rotation of the driveshaft of the crusher embodiment of FIG. 1, wherein the jaw moves continuously through positions 1, 2, 3 and 4 in sequence, then repeats.

FIG. 3*b* shows a text chart outlining key processes occurring within four stages of crushing and discharge for clockwise rotation of the driveshaft of the crusher embodiment of FIG. 1, wherein the jaw moves continuously in sequence through positions 1, 2, 3 and 4 of FIG. 3*a*.

FIG. 4*a* shows the sequence of jaw positions defining four stages of crushing and discharge for counter-clockwise rotation of the driveshaft of the crusher embodiment of FIG. 1, wherein the jaw moves continuously through positions 4, 3, 2 and 1 in reverse sequence, then repeats.

FIG. 4*b* shows a text chart outlining key processes occurring within four stages of crushing and discharge for counter-clockwise rotation of the driveshaft of the crusher embodiment of FIG. 1, wherein the jaw moves continuously in sequence through positions 4, 3, 2 and 1 of FIG. 4*a*.

Figure 5:
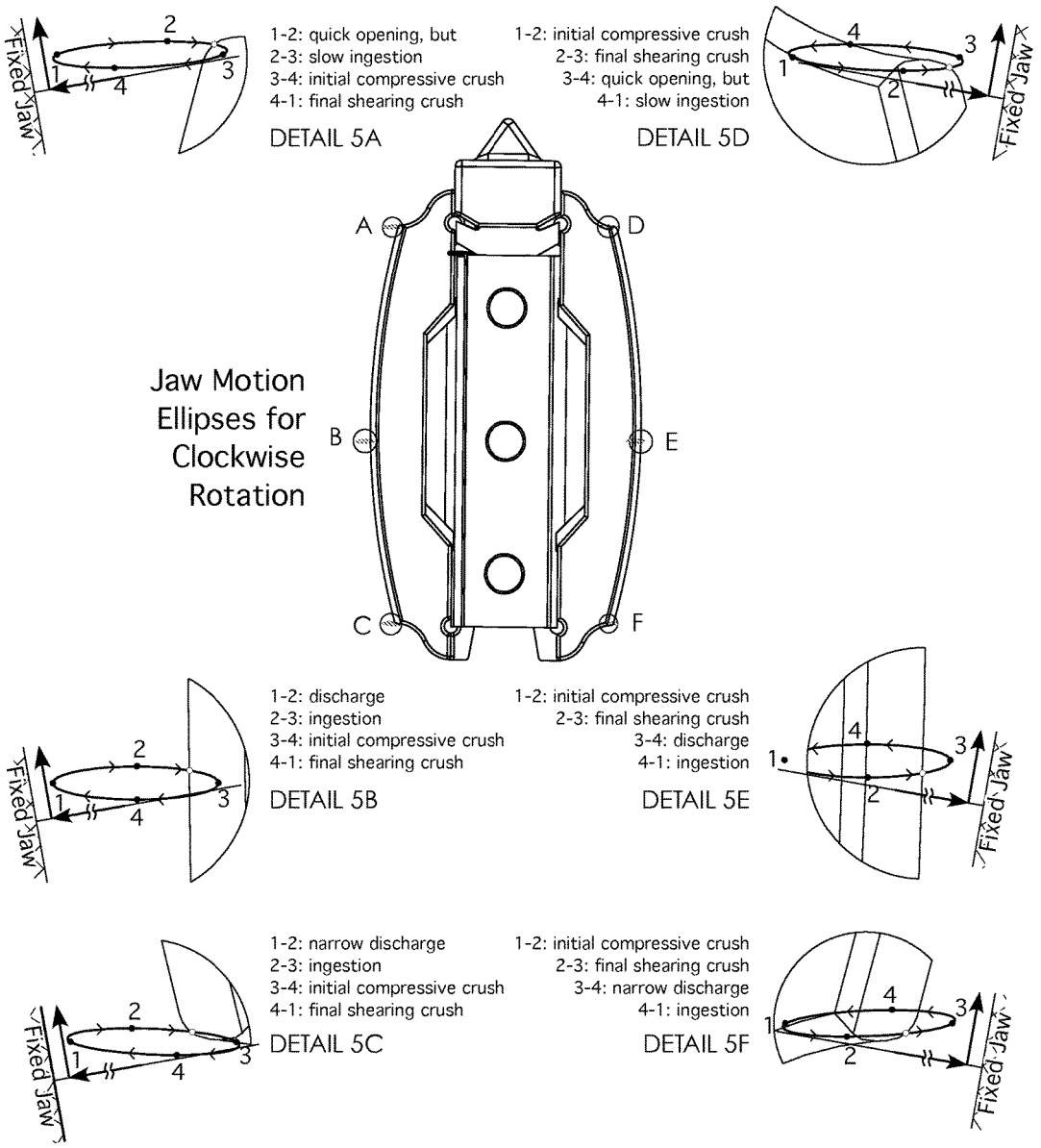

FIG. 5 shows details of the motion ellipses and force vectors at six points A to F on the moveable jaw for clockwise rotation of the driveshaft of the crusher embodiment of FIG. 1.

Figure 6:
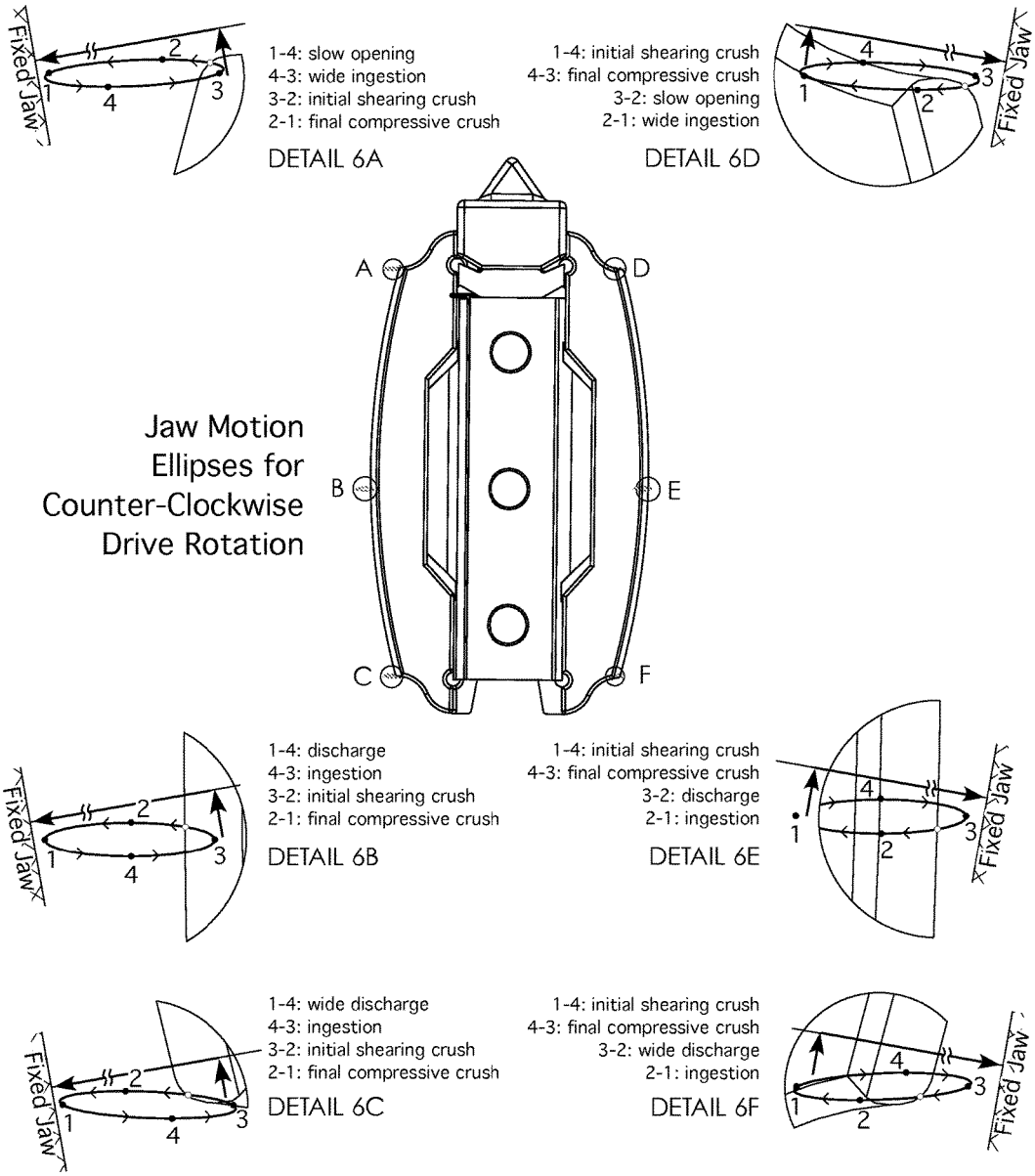

FIG. 6 shows details of the motion ellipses and force vectors at six points A to F on the moveable jaw for counter-clockwise rotation of the driveshaft of the crusher embodiment of FIG. 1.

Figure 7:
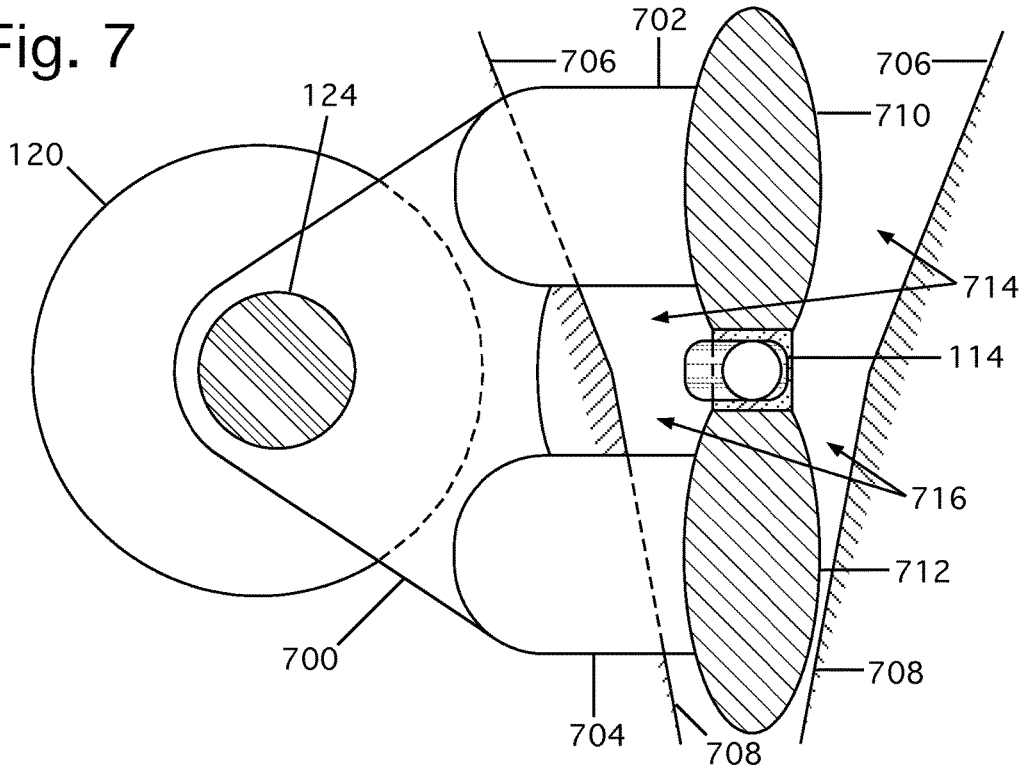

FIG. 7 provides an illustrative side view of an embodiment of a two-stage crusher wherein the eccentrics drive horizontally sliding dual jaws by means of connecting beams rigidly connected to the dual jaws.

Figure 8:
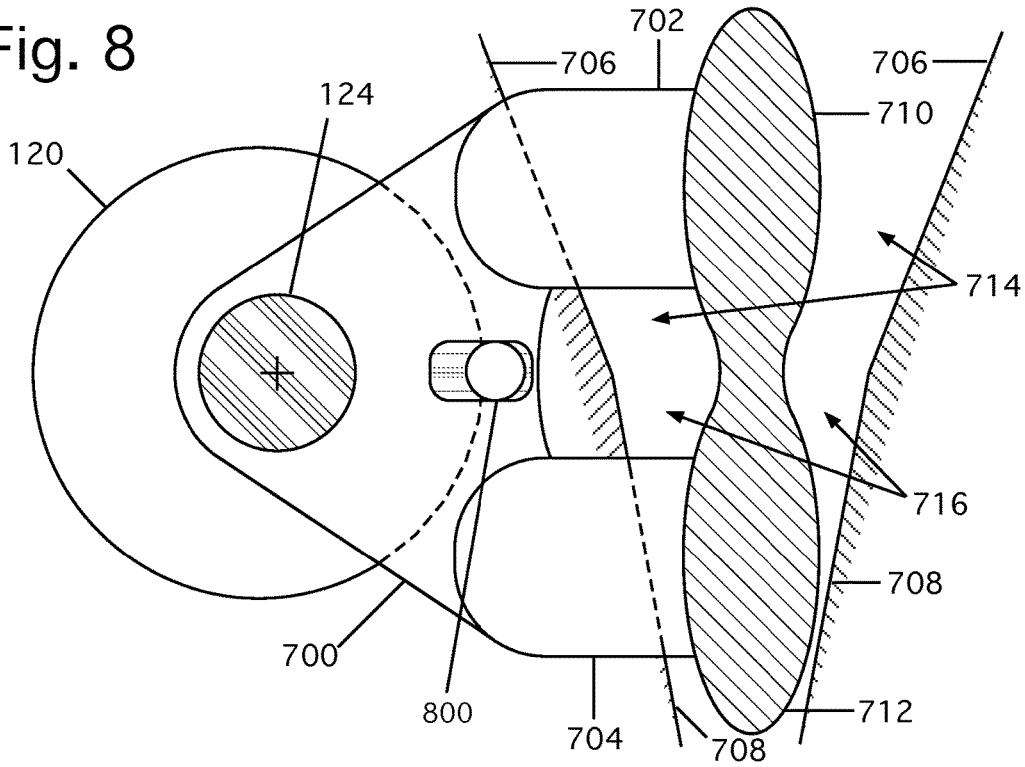

FIG. 8 provides an illustrative side view of an alternative embodiment of a two-stage crusher wherein the eccentrics drive dual jaws by means of horizontally sliding connecting beams rigidly connected to the dual jaws.

Figure 9:
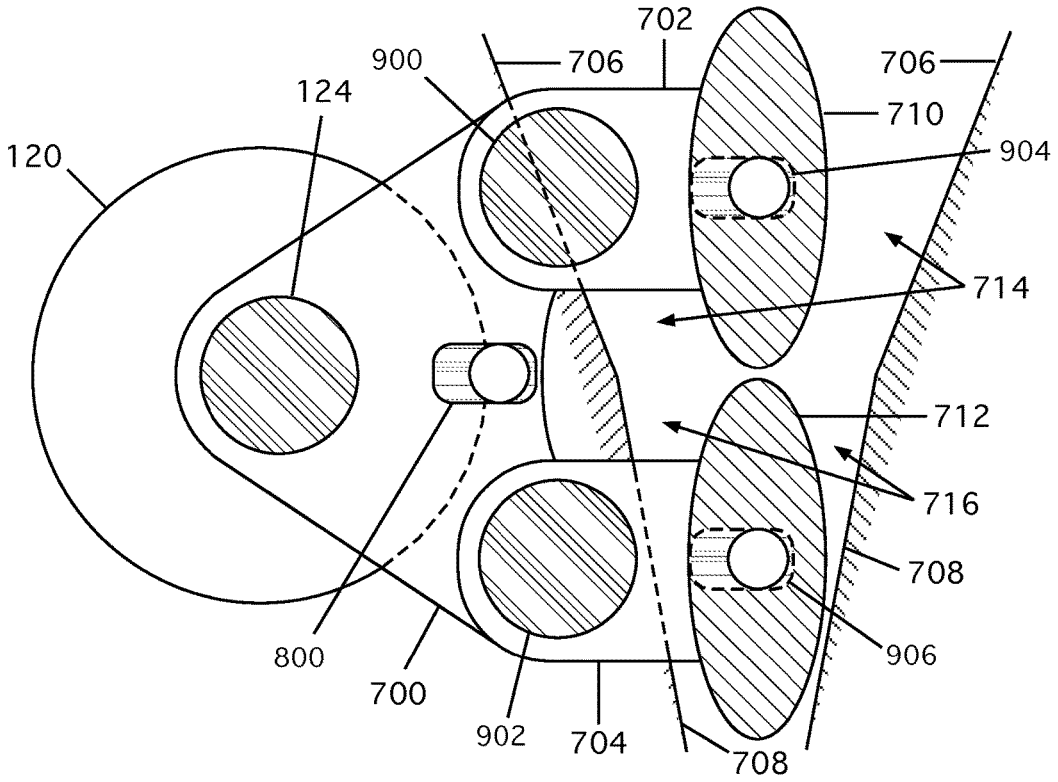

FIG. 9 provides an illustrative side view of an alternative embodiment of a two-stage crusher wherein the eccentrics drive horizontally sliding dual jaws by means of horizontally sliding connecting beams pivotally connected to arms rigidly connected to the dual jaws.

Drawings - Reference Numerals

| | | | |
|---|---|---|---|
| 100 | frame | 102 | base |
| 104 | side wall | 106 | fixed jaw |
| 108 | tapering chamber | 110 | vertical jaw |
| 112 | crushing surface | 114 | linear jaw bearing |
| 116 | bearing housing | 118 | driven shaft |
| 120 | flywheel | 122 | driving means |
| 124 | eccentric | 126 | connecting rod |
| 200 | first connecting rod | 202 | linear rod bearing |
| 204 | second connecting rod | 206 | pivot bearing |
| 700 | connecting beam | 702 | upper connecting arm |
| 704 | lower connecting arm | 706 | fixed upper jaw |
| 708 | fixed lower jaw | 710 | upper vertical jaw |
| 712 | lower vertical jaw | 714 | upper crushing chamber |
| 716 | lower crushing chamber | 800 | linear beam bearing |
| 900 | upper pivot bearing | 902 | lower pivot bearing |
| 904 | upper linear bearing | 906 | lower linear bearing |

DETAILED DESCRIPTION—FIG. 1—FIRST EMBODIMENT

One embodiment of the jaw crusher machine is illustrated in FIG. 1. This embodiment provides a jaw crusher machine comprising a substantially rectangular frame 100 having a horizontal base 102 and spaced apart interconnected side walls 104 extending upwardly from said base, a pair of fixed jaws 106 mounted transversely between said side walls so as to form the opposing walls of a downwardly tapering chamber 108, and a substantially vertical jaw member 110 having crushing surfaces 112 on opposite sides thereof, said vertical jaw member being pivotally connected substantially at the midpoint of its height to linear jaw bearings 114 affixed to each sidewall between said fixed jaws, said linear jaw bearings supporting and constraining said vertical jaw to substantially horizontal reciprocating pivotal motion, a bearing housing 116 extending across one end of said frame between said side walls and spaced above said base, a driven shaft 118 rotatably mounted within said bearing housing, a flywheel 120 concentrically attached to one end of said shaft, a reversible driving means 122 for rotating said flywheel and shaft, an eccentric 124 fixed on said shaft near each of its ends, substantially horizontally inclined connecting rods 126 carried by and operably connected at one of their ends to said eccentrics, the opposite ends of said connecting rods being rigidly connected to said vertical jaw member.

FIG. 2—SECOND EMBODIMENT

Figure 2:
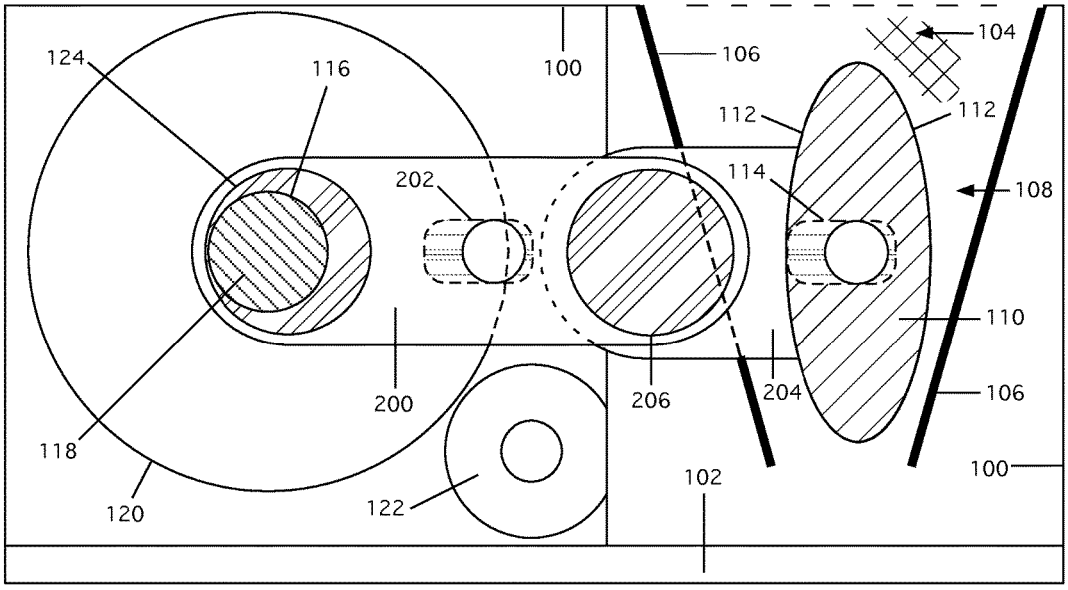
FIG. 2 shows an illustrative side view of an alternative embodiment of a single-stage crusher wherein the eccentrics drive the moveable jaw by means of first connecting rods pivotally connected to second connecting rods.

FIG. 2 illustrates an alternative embodiment of the present invention which provides a jaw, crusher machine comprising a substantially rectangular frame 100 having a horizontal base 102 and spaced apart interconnected side walls 104 extending upwardly from said base, a pair of fixed jaws 106 mounted transversely between said side walls so as to form the opposing walls of a downwardly tapering chamber 108, and a substantially vertical jaw member 110 having crushing surfaces 112 on opposite sides thereof, said vertical jaw member being pivotally connected substantially at the midpoint of its height to linear jaw bearings 114 affixed to each sidewall between said fixed jaws, said linear jaw bearings supporting and constraining said vertical jaw to substantially horizontal reciprocating pivotal motion, a bearing housing 116 extending across one end of said frame between said side walls and spaced above said base, a driven shaft 118 rotatably mounted within said bearing housing, a flywheel 120 concentrically attached to one end of said shaft, a reversible driving means 122 for rotating said flywheel and shaft, an eccentric 124 fixed on said shaft near each of its ends, inclined first connecting rods 200 carried by and operably connected at one of their ends to said eccentrics, said first connecting rods being pivotally supported at a point along their length by linear rod bearings 202 affixed to each adjacent sidewall, said linear rod bearings constraining said first connecting rods to substantially horizontal reciprocating pivotal motion, the opposite ends of said first connecting rods being pivotally connected to one end of substantially horizontally inclined second connecting rods 204 by pivot bearings 206, the opposite ends of said second connecting rods being rigidly attached to said vertical jaw member.

Operation—FIGS. 1, 2, 3*a*, 3*b*, 4*a*, 4*b*, 5, 6

The manner of using the jaw crushers embodied in FIGS. 1 and 2 is similar to that for jaw crushers in present use. Material to be crushed enters the top of the crushing chamber while a driveshaft with attached eccentric is rotated to drive a reciprocating jaw within the crushing chamber. Crushed material falls out the bottom of the chamber while fresh feed enters above.

A unique aspect of the present invention that provides advantages over existing machines is the versatile design that gives the ability to control and, when required, change important details of the crushing action. For example, component dimensions (e.g. bearing diameters, connecting arm lengths, linear bearing placements, etc.) chosen by the machine designer determine the magnitude and timing of small-scale jaw movements. These experience-guided design choices, in combination with operator-controlled reversible rotation, provide a means to control important aspects of the crushing action in the field.

Clockwise Rotation—

Consider first the details of jaw movement for clockwise rotation as shown in FIGS. 3*a* and 3*b*. Clockwise rotation of the jaw crusher embodiment of FIG. 1 causes the vertical jaw to move continuously in sequence through positions 1, 2, 3 and 4, and on around to 1 again. Position 1 puts the jaw in its left-most position, from where 90° of clockwise rotation moves the jaw to mid-chamber position 2, another 90° of rotation moves the jaw to its right-most position 3, and a third increment of 90° moves the jaw to mid-chamber position 4. A final 90° of rotation puts the jaw back in position 1, and the cycle repeats.

As the jaw begins its first (right-side) crushing stroke by moving right from position 1 to 2, the jaw tilts clockwise so the feed chamber behind the moving jaw at first opens wider at the top than it does at the bottom. Fresh feed material cannot enter the crusher until material crushed on the previous stroke has been discharged. Thus, for clockwise rotation, ingestion of fresh feed at the top left is impeded during the initial 1-2 portion of the stroke because the relatively narrow jaw opening at the bottom left holds back the discharge of crushed material at that point.

As the jaw completes its right-side clockwise crushing stroke by moving from position 2 to 3, the jaw straightens up to vertical as it moves to its right-most position. The feed chamber finally opens wide at the bottom left, fully releasing the crushed material and allowing fresh feed to enter the left chamber. Inspection of FIGS. 3*a* and 3*b* reveals that, for clockwise rotation, the first half of the right-side discharge stroke from position 3 to 4, and the last half of the stroke from position 4 to 1, are essentially a repeat of the left-side discharge stroke in terms of obstructing material flow due to the late timing of jaw opening and discharge.

With clockwise rotation, the free discharge of crushed material (and subsequent ingestion of fresh feed) is delayed to the last half of each discharge stroke. Thus a distinctive effect of clockwise rotation is to impede material passage through the crusher. There are, however, offsetting advantages of clockwise rotation that provide flexibility when processing different types of feed material, and these will be discussed later below.

Counter-Clockwise Rotation—

Now consider the details of jaw movement for counter-clockwise rotation as illustrated in FIGS. 4*a* and 4*b*. Counter-clockwise driving rotation causes the vertical jaw to move continuously in sequence through positions 1, 4, 3, 2 and back to 1. As before, position 1 starts the jaw in its left-most position, then 90° of counter-clockwise rotation moves the jaw to mid-chamber position 4, another 90° of rotation moves the jaw to its right-most position 3, and a third increment of 90° moves the jaw to mid-chamber position 2. A final 90° of rotation puts the jaw back in position 1, and the cycle repeats.

As the jaw begins its first (right-side) crushing stroke by moving right from position 1 to 4, the jaw tilts counter-clockwise so the feed chamber behind the moving jaw at first opens wider at the bottom than it does at the top. Early in the first half of the stroke, crushed material in the left chamber is free to discharge and quickly makes room for crushed material to move down through the crusher. Thus, for counter-clockwise rotation, ingestion of fresh feed at the top left is assisted during the initial 1-4 portion of the stroke because the relatively wide jaw opening at the bottom left allows crushed material to freely discharge at that point, making room to ingest fresh feed material.

As the jaw completes its right-side counter-clockwise crushing stroke by moving from position 4 to 3, the jaw straightens back to vertical as it moves to its right-most position. The feed chamber finally opens wide at the top left, allowing unimpeded and quick ingestion of fresh feed into the crusher. Inspection of FIGS. 4*a* and 4*b* reveals that, for counter-clockwise rotation, the first half of the right-side discharge stroke from position 3 to 2, and the last half of the stroke from position 2 to 1, are essentially a repeat of the left-side discharge stroke in terms of assisting material flow due to the early timing of jaw opening and discharge.

With counter-clockwise rotation, the free discharge of crushed material (and subsequent ingestion of fresh feed) begins quickly in the first half of each discharge stroke. Thus a distinctive effect of counter-clockwise rotation is to assist material passage through the crusher. There are also other advantages of counter-clockwise rotation that provide flexibility when processing different types of feed material, and these will now be discussed.

Jaw Motion Ellipses for Clockwise Drive Rotation—

Consider FIG. 5, which shows jaw motion ellipses at six points on the vertical jaw for clockwise rotation of the jaw crusher drive shaft. Details 5A, 5B and 5C show the elliptical path at three points on the vertical jaw's left surface during one complete clockwise rotation of the drive mechanism. The elliptical motion begins with the left-hand discharge/intake stroke (which is also the right-hand crushing stroke) as the jaw moves first from position 1 to position 2, then on to position 3. The left-hand crushing stroke completes the ellipse as the jaw moves from position 3 to position 4, then on to position 1.

Details 5D, 5E and 5F show the corresponding elliptical paths of motion at three similar points directly opposite on the vertical jaw's right side. The ellipses begin with the right-hand crushing stroke as the jaw moves first from position 1 to position 2, then on to position 3. The ellipse is completed by the right-hand discharge/intake stroke as the jaw moves from position 3 to position 4, then on to position 1.

The arrows drawn perpendicular and tangential to the fixed jaws illustrate respectively the compressive and shearing forces developed on either side of the vertical jaw during the crushing strokes. In Detail 5D for example, during the initial part of the right-hand crushing stroke when the jaw moves from position 1 to position 2, the elliptical path of motion is substantially perpendicular to the fixed jaw and the crushing forces developed are thus mostly compressive. In the final part of the right-hand crushing stroke as the jaw moves from position 2 to position 3, the elliptical path of motion curves up and parallel to the fixed jaw and the crushing forces develop a significant up-angled shear component parallel to the fixed jaw.

The jaw motion ellipses of FIG. 5 show how clockwise rotation of the drive flywheel produces a crushing stroke that starts with compression perpendicular to the fixed jaws, and ends with a shearing movement directed up along the surface of the fixed jaws. This two-step crushing and shearing movement is quite similar to human jaw motions when chewing food, wherein the teeth first crush down to grip and cut the food material and then shear sideways to tear and shred it.

A two-step "chewing" action of initial compression and final shear works well to break up feed materials that are relatively soft and adhesive. With clockwise drive rotation, the final upward-angled shearing motion of the crushing stroke tends to scrape adhered material off the fixed jaws and thereby helps prevent plugging with softer materials such as asphalt. A brief period of clockwise operation is also useful to help free up the crusher if it plugs during counter-clockwise operation.

When crushing hard materials with clockwise drive rotation, upward-angled shear forces at the end of the crushing stroke unfortunately tend to "spit" hard stones and chunks back upwards against the incoming feed, thereby reducing throughput. Clockwise drive rotation also causes the chamber of crushed material to open relatively slowly at the bottom compared with the top. Slow opening at the bottom reduces throughput by impeding the discharge of crushed material from below, which then delays ingestion of new material at the top. Thus, although clockwise drive rotation of the present invention is advantageous for crushing soft feed materials, clockwise rotation is less satisfactory for crushing hard materials.

Jaw Motion Ellipses for Counter-Clockwise Drive Rotation—

Now consider FIG. 6, which shows jaw motion ellipses at six points on the vertical jaw for counter-clockwise rotation of the jaw crusher drive shaft. Details 6A, 6B and 6C show the elliptical path at three points on the vertical jaw's left surface during one complete counter-clockwise rotation of the drive mechanism. The ellipses begin with the left-hand discharge/intake stroke as the jaw moves first from position 1 to position 4, then on to position 3. The left-hand crushing stroke completes the ellipse as the jaw moves from position 3 to position 2, then on to position 1.

Details 6D, 6E and 6F show the corresponding elliptical paths of motion at three similar points directly opposite on the vertical jaw's right side. The ellipses begin with the right-hand crushing stroke as the jaw moves first from position 1 to position 4, then on to position 3. The right-hand discharge/intake stroke (which is also the left-hand crushing stroke) completes the ellipse as the jaw moves from position 3 to position 2, then on to position 1.

The arrows drawn perpendicular and tangential to the fixed jaws illustrate respectively the compressive and shearing forces developed on either side of the vertical jaw during the crushing strokes. In detail 6D for example, during the initial part of the right-hand crushing stroke when the jaw moves from position 1 to position 4, the motion ellipse curves up parallel to, then toward, the fixed jaw, giving the initial crushing forces a significant up-angled shear component parallel to the fixed jaw. In the final part of the right-hand crushing stroke as the jaw moves from position 4 to position 3, the elliptical motion is substantially perpendicular to the fixed jaw and the crushing forces developed are thus mostly compressive.

The jaw motion ellipses of FIG. 6 show how counter-clockwise rotation of the drive flywheel produces a crushing stroke that begins with shear forces upwardly-directed parallel to the fixed jaws. The crushing stroke ends with compressive crushing forces directed perpendicular to the surface of the fixed jaws. This sequence of shear and compression is similar to that in a roll crusher, wherein the feed material is initially placed in partial shear parallel to the fixed jaw before it is crushed by compression. The shear force rotates the feed chunks until they brace themselves on a flat spot and stop rolling, at which point the moving jaw pins the chunks in place and the crushing force becomes compressive. The shear-induced 'spit-back' rejection of feed sometimes encountered with clockwise drive rotation is reduced or eliminated because the large crushing forces at the end of the stroke are mainly compressive.

On a 'counter-clockwise' discharge stroke, the crushing chamber opens more quickly at the bottom and more slowly at the top. Quick opening at the bottom increases throughput by hastening the discharge of crushed material from below to make room for ingestion of new material at the top (i.e. one must breath out before breathing in). Thus, counter-clockwise drive rotation of the present invention reduces feed rejection and increases throughput, making it particularly effective with hard materials.

FIGS. 7, 8, 9—ADDITIONAL EMBODIMENTS—MULTI-STAGE CRUSHING

The performance envelope of the single-stage crushers shown in FIGS. 1 and 2 can be extended by, for example, adapting their mechanisms to perform the crushing action in multiple stages.

FIG. 7 illustrates an alternative embodiment of the crusher of FIG. 1 wherein crushing takes place in two stages. Eccentrics 124 drive upper jaws 710 and lower jaws 712 by means of connecting beams 700 rigidly connected to the upper and lower jaws via connecting arms 702 and 704 respectively. The upper and lower jaws are jointly constrained to horizontally sliding pivotal motion by linear bearings 114. The upper jaw reciprocates horizontally within a downwardly tapering chamber 714 formed by fixed upper jaws 706, while the lower jaw reciprocates within a downwardly tapering chamber 716 formed by fixed lower jaws 708.

FIG. 8 illustrates another alternative embodiment for two-stage crushing wherein eccentrics 124 drive upper jaws 710 and lower jaws 712 by means of connecting beams 700 constrained to horizontally sliding pivotal motion by linear bearings 800. The connecting beams rigidly connect to the upper and lower jaws via connecting arms 702 and 704 respectively. The upper jaw reciprocates within a downwardly tapering chamber 714 formed by fixed upper jaws 706, while the lower jaw reciprocates within a downwardly tapering chamber 716 formed by fixed lower jaws 708.

FIG. 9 illustrates still another alternative embodiment for two-stage crushing which effectively combines the mechanisms of FIGS. 2, 7 and 8. Eccentrics 124 drive upper jaws 710 and lower jaws 712 by means of connecting beams 700 constrained to horizontally sliding motion by linear bearings 800. The connecting beams pivotally connect to upper and lower connecting arms 702 and 704 via upper and lower pivot bearings 900 and 902 respectively. The upper and lower connecting arms are rigidly connected to the upper and lower jaws respectively. The upper and lower jaws are constrained to horizontally sliding pivotal motion by linear bearings 904 and 906 respectively. The upper jaw reciprocates within downwardly tapering chamber 714 formed by fixed upper jaws 706, while the lower jaw reciprocates within downwardly tapering chamber 716 formed by fixed lower jaws 708.

Advantages

From the descriptions above, a number of advantages of some embodiments of my jaw crusher machine become evident:

(a) Linear bearings reduce the unintended shear forces that encourage abrasive wear in other designs.

(b) Straightforward machine design parameters such as arm length and pivot location of connecting arms, etc., give the designer great flexibility to fine-tune the jaw motion and crushing forces for best performance.

(c) By simply changing the direction of drive rotation, the crushing action can be varied to suit either hard or soft feed materials.

(d) Briefly changing the direction of drive rotation is helpful for clearing the machine if it becomes plugged during operation.

(e) The machine can be operated so that crushing forces begin with compression and end with shear, thereby providing a self-cleaning jaw action that encourages throughput and helps to reduce plugging when crushing soft feed materials.

(f) The machine can be operated so that crushing forces begin with gentle shear and end with strong compression, permitting the use of hard but slippery wear-resistant jaw materials such as chrome white iron without encountering spit-back rejection of hard feed materials.

(g) The machine design is compact, sturdy, runs smoothly and is easy to operate, making it well suited for portable use under harsh field conditions.

CONCLUSIONS, RAMIFICATIONS AND SCOPE

Accordingly, the reader will see that the jaw crusher machines of the various embodiments can be used to crush a wide range of feed materials either hard or soft, at field locations suitable for permanent or portable installations, and when plugged can be easily cleared, sometimes with just the press of a button. Furthermore, the jaw crusher machine has additional advantages in that:

- it is less vulnerable than other designs to abrasive wear due to unpurposed shear forces;
- it can be configured to process either hard or soft materials simply by pressing a button to control the direction of drive rotation;
- the machine designer can, via small changes to the machine geometry, precisely control the elliptical jaw motions that determine the magnitude and timing of jaw openings during the discharge stroke, and of compressive and shear forces during the crushing stroke.

Although the descriptions above are quite specific, this should not be construed as limiting the scope of the embodiments but as merely providing illustrations of some of several embodiments. For example, the vertical jaws may be asymmetrical either vertically or horizontally; the fixed jaws may be curved rather than flat; the vertical and fixed jaws need not be made of the same materials, etc.

Thus the scope of the embodiments should be determined by the appended claims and their legal equivalents, rather than by the examples given.

I claim:

1. A jaw crusher machine comprising:

a. a substantially rectangular frame having a horizontal base and spaced apart interconnected side walls extending upwardly from said base, b. a pair of fixed jaws mounted transversely between said side walls so as to form the opposing walls of a downwardly tapering chamber, and c. a substantially vertical jaw member having crushing surfaces on opposite sides thereof, d. said vertical jaw member being pivotally connected substantially at the midpoint of its height to linear jaw bearings affixed to each sidewall between said fixed jaws, e. said linear jaw bearings supporting and constraining said vertical jaw to substantially horizontal reciprocating pivotal motion, f. a bearing housing extending across one end of said frame between said side walls and spaced above said base, g. a driven shaft rotatably mounted within said bearing housing, h. a flywheel concentrically attached to one end of said shaft, i. a reversible driving means for rotating said flywheel and shaft, j. an eccentric fixed on said shaft near each of its ends, k. substantially horizontally inclined connecting rods carried by and operably connected at one of their ends to said eccentrics, l. the opposite ends of said connecting rods being rigidly connected to said vertical jaw member.

2. A jaw crusher machine as in claim 1 wherein the crushing surfaces on one or more jaw members are made of chrome white iron.

3. A jaw crusher machine as in claim 1 wherein, during the initial portion of a stroke, the driving means rotates the flywheel to cause an elliptical motion of the vertical jaw substantially perpendicular to the opposed fixed jaw.

4. A jaw crusher machine as in claim 1 wherein, during the initial portion of a stroke, the driving means rotates the flywheel to cause an elliptical motion of the vertical jaw substantially parallel to the opposed fixed jaw.

5. A jaw crusher machine as in claim 1 wherein, during the final portion of a stroke, the driving means rotates the flywheel to cause an elliptical motion of the vertical jaw substantially parallel to the opposed fixed jaw.

6. A jaw crusher machine as in claim 1 wherein, during the final portion of a stroke, the driving means rotates the flywheel to cause an elliptical motion of the vertical jaw substantially perpendicular to the opposed fixed jaw.

7. A jaw crusher machine as in claim 1 wherein, during the initial portion of a stroke, the driving means moves the vertical jaw to close the crushing zone between said vertical jaw and the opposed fixed jaw more quickly above the midpoint of said vertical jaw than below it.

8. A jaw crusher machine as in claim 1 wherein, during the initial portion of a stroke, the driving means moves the vertical jaw to close the crushing zone between said vertical jaw and the opposed fixed jaw more slowly above the midpoint of said vertical jaw than below it.

9. A jaw crusher machine as in claim 1 wherein, during the final portion of a stroke, the driving means moves the vertical jaw to close the crushing zone between said vertical jaw and the opposed fixed jaw more slowly above the midpoint of said vertical jaw than below it.

10. A jaw crusher machine as in claim 1 wherein, during the final portion of a stroke, the driving means moves the vertical jaw to close the crushing zone between said vertical jaw and the opposed fixed jaw more quickly above the midpoint of said vertical jaw than below it.

11. A jaw crusher machine as in claim 1 wherein, during the initial portion of a stroke, the driving means moves the vertical jaw to open the discharge zone between said vertical jaw and the opposed fixed jaw more quickly below the midpoint of said vertical jaw than above it.

12. A jaw crusher machine as in claim 1 wherein, during the initial portion of a stroke, the driving means moves the vertical jaw to open the discharge zone between said vertical jaw and the opposed fixed jaw more slowly below the midpoint of said vertical jaw than above it.

13. A jaw crusher machine as in claim 1 wherein, during the final portion of a stroke, the driving means moves the vertical jaw to open the discharge zone between said vertical jaw and the opposed fixed jaw more slowly below the midpoint of said vertical jaw than above it.

14. A jaw crusher machine as in claim 1 wherein, during the final portion of a stroke, the driving means moves the vertical jaw to open the discharge zone between said vertical jaw and the opposed fixed jaw more quickly below the midpoint of said vertical jaw than above it.

15. A jaw crusher machine comprising:

a. a substantially rectangular frame having a horizontal base and spaced apart interconnected side walls extending upwardly from said base, b. a pair of fixed jaws mounted transversely between said side walls so as to form the opposing walls of a downwardly tapering chamber, and c. a substantially vertical jaw member having crushing surfaces on opposite sides thereof, d. said vertical jaw member being pivotally connected substantially at the midpoint of its height to linear jaw bearings affixed to each sidewall between said fixed jaws, e. said linear jaw bearings supporting and constraining said vertical jaw to substantially horizontal reciprocating pivotal motion, f. a bearing housing extending across one end of said frame between said side walls and spaced above said base, g. a driven shaft rotatably mounted within said bearing housing, h. a flywheel concentrically attached to one end of said shaft, i. a reversible driving means for rotating said flywheel and shaft, j. an eccentric fixed on said shaft near each of its ends, k. inclined first connecting rods carried by and operably connected at one of their ends to said eccentrics, l. said first connecting rods being pivotally supported at a point along their length by linear rod bearings affixed to each adjacent sidewall, m. said linear rod bearings constraining said first connecting rods to substantially horizontal reciprocating pivotal motion, n. the opposite ends of said first connecting rods being pivotally connected to one end of substantially horizontally inclined second connecting rods, o. the opposite ends of said second connecting rods being rigidly connected to said vertical jaw member.

16. A jaw crusher machine as in claim 15 wherein the crushing surfaces on one or more jaw members are made of chrome white iron.

17. A jaw crusher machine as in claim 15 wherein, during the initial portion of a stroke, the driving means rotates the flywheel to cause an elliptical motion of the vertical jaw substantially perpendicular to the opposed fixed jaw.

18. A jaw crusher machine as in claim 15 wherein, during the initial portion of a stroke, the driving means rotates the flywheel to cause an elliptical motion of the vertical jaw substantially parallel to the opposed fixed jaw.

19. A jaw crusher machine as in claim 15 wherein, during the final portion of a stroke, the driving means rotates the flywheel to cause an elliptical motion of the vertical jaw substantially parallel to the opposed fixed jaw.

20. A jaw crusher machine as in claim 15 wherein, during the final portion of a stroke, the driving means rotates the flywheel to cause an elliptical motion of the vertical jaw substantially perpendicular to the opposed fixed jaw.

21. A jaw crusher machine as in claim 15 wherein, during the initial portion of a stroke, the driving means moves the vertical jaw to close the crushing zone between said vertical jaw and the opposed fixed jaw more quickly above the midpoint of said vertical jaw than below it.

22. A jaw crusher machine as in claim 15 wherein, during the initial portion of a stroke, the driving means moves the vertical jaw to close the crushing zone between said vertical jaw and the opposed fixed jaw more slowly above the midpoint of said vertical jaw than below it.

23. A jaw crusher machine as in claim 15 wherein, during the final portion of a stroke, the driving means moves the vertical jaw to close the crushing zone between said vertical jaw and the opposed fixed jaw more slowly above the midpoint of said vertical jaw than below it.

24. A jaw crusher machine as in claim 15 wherein, during the final portion of a stroke, the driving means moves the vertical jaw to close the crushing zone between said vertical jaw and the opposed fixed jaw more quickly above the midpoint of said vertical jaw than below it.

25. A jaw crusher machine as in claim 15 wherein, during the initial portion of a stroke, the driving means moves the vertical jaw to open the discharge zone between said vertical jaw and the opposed fixed jaw more quickly below the midpoint of said vertical jaw than above it.

26. A jaw crusher machine as in claim 15 wherein, during the initial portion of a stroke, the driving means moves the vertical jaw to open the discharge zone between said vertical jaw and the opposed fixed jaw more slowly below the midpoint of said vertical jaw than above it.

27. A jaw crusher machine as in claim 15 wherein, during the final portion of a stroke, the driving means moves the vertical jaw to open the discharge zone between said vertical jaw and the opposed fixed jaw more slowly below the midpoint of said vertical jaw than above it.

28. A jaw crusher machine as in claim 15 wherein, during the final portion of a stroke, the driving means moves the vertical jaw to open the discharge zone between said vertical jaw and the opposed fixed jaw more quickly below the midpoint of said vertical jaw than above it.

* * * * *